US008186788B2

(12) United States Patent
Moriyama et al.

(10) Patent No.: US 8,186,788 B2
(45) Date of Patent: May 29, 2012

(54) PRINTHEAD, PRINTING APPARATUS, AND PRINTHEAD DRIVING METHOD

(75) Inventors: Jiro Moriyama, Kawasaki (JP); Atsushi Sakamoto, Kawasaki (JP); Hirokazu Tanaka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 616 days.

(21) Appl. No.: 12/326,823

(22) Filed: Dec. 2, 2008

(65) Prior Publication Data

US 2009/0141059 A1 Jun. 4, 2009

(30) Foreign Application Priority Data

Dec. 3, 2007 (JP) ..... 2007-312657

(51) Int. Cl.
*B41J 29/38* (2006.01)

(52) U.S. Cl. ..... 347/9; 347/12

(58) Field of Classification Search ..... 347/9
See application file for complete search history.

(56) References Cited

U.S. PATENT DOCUMENTS 6,145,948 A * 11/2000 Kishida ..... 347/13

FOREIGN PATENT DOCUMENTS

JP 6-328722 11/1994

* cited by examiner

*Primary Examiner* — Uyen Chau N Le
*Assistant Examiner* — Kajli Prince
(74) *Attorney, Agent, or Firm* — Canon USA Inc IP Division

(57) ABSTRACT

A printhead includes a driving unit configured to drive a plurality of heaters, a register configured to input data of a plurality of bits corresponding to the number of heaters, a latch configured holding the data transferred from the register; a generation unit configured to generate a control signal of the driving unit for each heater based on a value of the data and a change in a level of an enable signal including a plurality of pulse signals; and an output unit outputting the control signal generated by the generation unit to the driving unit in synchronism with the pulse signals.

6 Claims, 11 Drawing Sheets

PRINTHEAD, PRINTING APPARATUS, AND PRINTHEAD DRIVING METHOD

BACKGROUND OF THE INVENTION

1. Field of the Invention

The present invention relates to a printhead, a printing apparatus, and a printhead driving method and, more particularly, to a printhead which is provided with heaters in correspondence with discharge orifices that discharge ink and discharges ink by heating the heaters, a thermal inkjet printing apparatus using the printhead, and a driving method for the printhead.

2. Description of the Related Art

Conventional inkjet printing apparatuses form images by discharging small ink droplets onto the surfaces of print media. In recent years, various print media are printed using inks of a plurality of colors such as black (Bk), cyan (C), magenta (M), and yellow (Y). In particular, a thermal inkjet printing apparatus can finely control the ink discharge amount by controlling the amount of energy supplied to heaters provided in correspondence with discharge orifices. An inkjet printing apparatus has also been known, which changes the amount of energy supplied to the heaters in accordance with the temperature of the printhead or ink.

The temperature of a thermal printhead rises upon a continuous print operation. As the temperature of the printhead or ink changes, the ink discharge amount upon supplying the same amount of energy to the heaters changes. For this reason, most of the inkjet printing apparatuses control to maintain the printheads at high temperatures in advance by heating the printheads as their temperatures drop. The discharge and non-discharge of inks from the printheads are controlled on demand. Under the circumstance, Japanese Patent Laid-Open No. 6-328722, for example, discloses an inkjet printing apparatus which applies, to an electrothermal transducer (heater) which does not discharge ink in printing, energy in an amount that does not allow it to discharge ink.

However, the inkjet printing apparatus disclosed in Japanese Patent Laid-Open No. 6-328722 described above requires a separate circuit to apply, to a heater which does not discharge ink, energy in an amount that does not allow it to discharge ink, so the circuitry in the inkjet printing apparatus is complicated. In addition, the number of electrical wiring lines from a data control unit of the inkjet printing apparatus to the printhead increases. For example, note that the main board mounting the data control unit of the inkjet printing apparatus and the printhead are connected via a cable. The larger the number of electrical wiring lines, the larger the sizes of the cable and connector, resulting in increases in apparatus size and cost. Furthermore, printhead temperature control cannot be done independently of ink discharge control.

SUMMARY OF THE INVENTION

The present invention enables to provide a printhead which can be maintained at a constant temperature by applying energy to a heater which does not discharge ink in printing, independently of print control, with a simple configuration and low cost, a printing apparatus, and a printhead driving method.

According to a first aspect of the present invention, there is provided a printhead including a driving unit configured to drive a plurality of heaters, and a register configured to input data of a plurality of bits corresponding to the number of heaters, a latch holding the data transferred from the register; a generation unit configured to generate a control signal of the driving unit for each heater based on a value of the data and a change in a level of an enable signal including a plurality of pulse signals; and an output unit outputting the control signal generated by the generation unit to the driving unit in synchronism with the pulse signals.

According to a second aspect of the present invention, there is provided a driving method for a printhead including a driving unit configured to drive a plurality of heaters, and a register configured to input data of a plurality of bits corresponding to the number of heaters, the method including holding the data transferred from the register; generating a control signal of the driving unit for each heater based on a value of the data and a change in a level of an enable signal including a plurality of pulse signals; and driving the heater based on the enable signal and the control signal generated.

Further features of the present invention will become apparent from the following description of exemplary embodiments with reference to the attached drawings.

DESCRIPTION OF THE EMBODIMENTS

Exemplary embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

In this specification, "printing" means not only forming significant information such as characters or graphics but also forming, for example, an image, design, or pattern on a print medium in a broad sense regardless of whether the formed information is significant, or processing the medium as well.

In addition, the formed information need not always be visualized so as to be visually recognized by humans.

Also, a "print medium" means not only a paper sheet for use in a general printing apparatus but also a member which can fix ink, such as cloth, plastic film, metallic plate, glass, ceramics, lumber, or leather in a broad sense.

Also, "ink" should be interpreted in a broad sense as in the definition of "printing" mentioned above, and means a liquid which can be used to form, for example, an image, design, or pattern, process a print medium, or perform ink processing upon being supplied onto the print medium. The ink processing includes, for example, solidification or insolubilization of a coloring material in ink supplied onto a print medium.

Also, a "nozzle" generically means an orifice, a liquid channel which communicates with it, and an element which generates energy used for ink discharge, unless otherwise specified.

Figure 5:
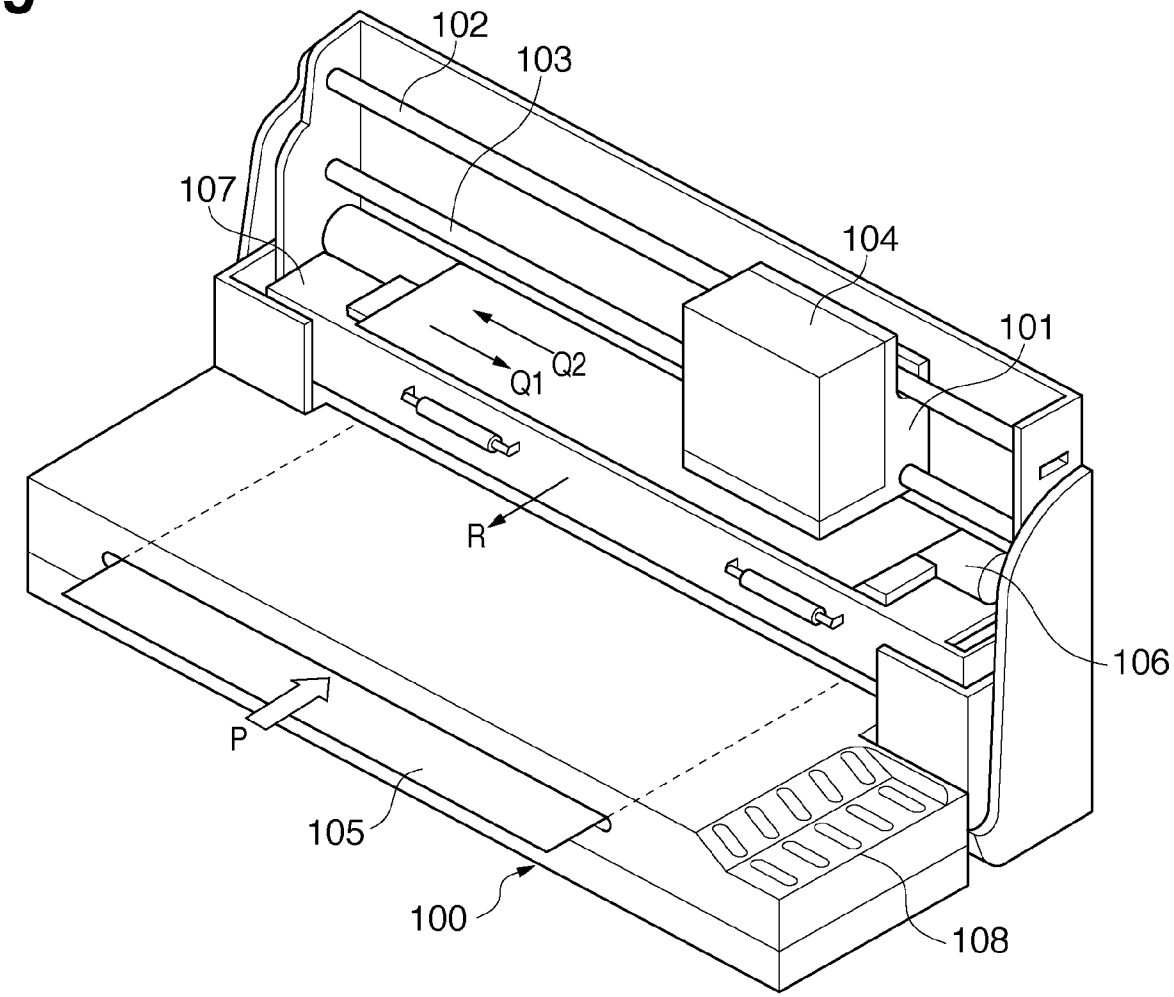
FIG. 5 is a perspective view for explaining an inkjet printing apparatus to which the present invention is applicable.

FIG. 5 is a perspective view for explaining an inkjet printing apparatus to which the present invention is applicable.

The conveyance direction of a print medium 105 conveyed in the direction indicated by an arrow P from the sheet feed position on the front side of an inkjet printing apparatus (to be also merely referred to as a printing apparatus hereinafter) 100 in FIG. 5 is reversed on the rear side of the printing apparatus 100 in FIG. 5. After that, the print medium 105 is fed in the direction indicated by an arrow R (sub scanning direction) by a feed roller 106 to the print enable region of a printhead 104. A platen 107 is set on the lower side of the print medium 105 in the print enable region.

Two guide shafts 102 and 103 can guide movement of a carriage 101 in the directions indicated by arrows Q1 and Q2 (main scanning direction) along their axial directions. The carriage 101 reciprocates in a scanning region including the print enable region by the drive of a stepping motor (not shown). The maximum print enable width of this printing apparatus is the width of an A4-size sheet, that is, about 210 mm.

The carriage 101 mounts the printhead 104 which can discharge ink from its discharge orifices. After the end of one print scanning operation of the printhead 104, the print medium 105 is conveyed in the sub scanning direction indicated by the arrow R by a predetermined amount, and the printhead 104 stands by for the next print scanning. By repeating the print scanning and the conveyance of the print medium 105, an image is printed on one page of the print medium 105.

Figure 6:
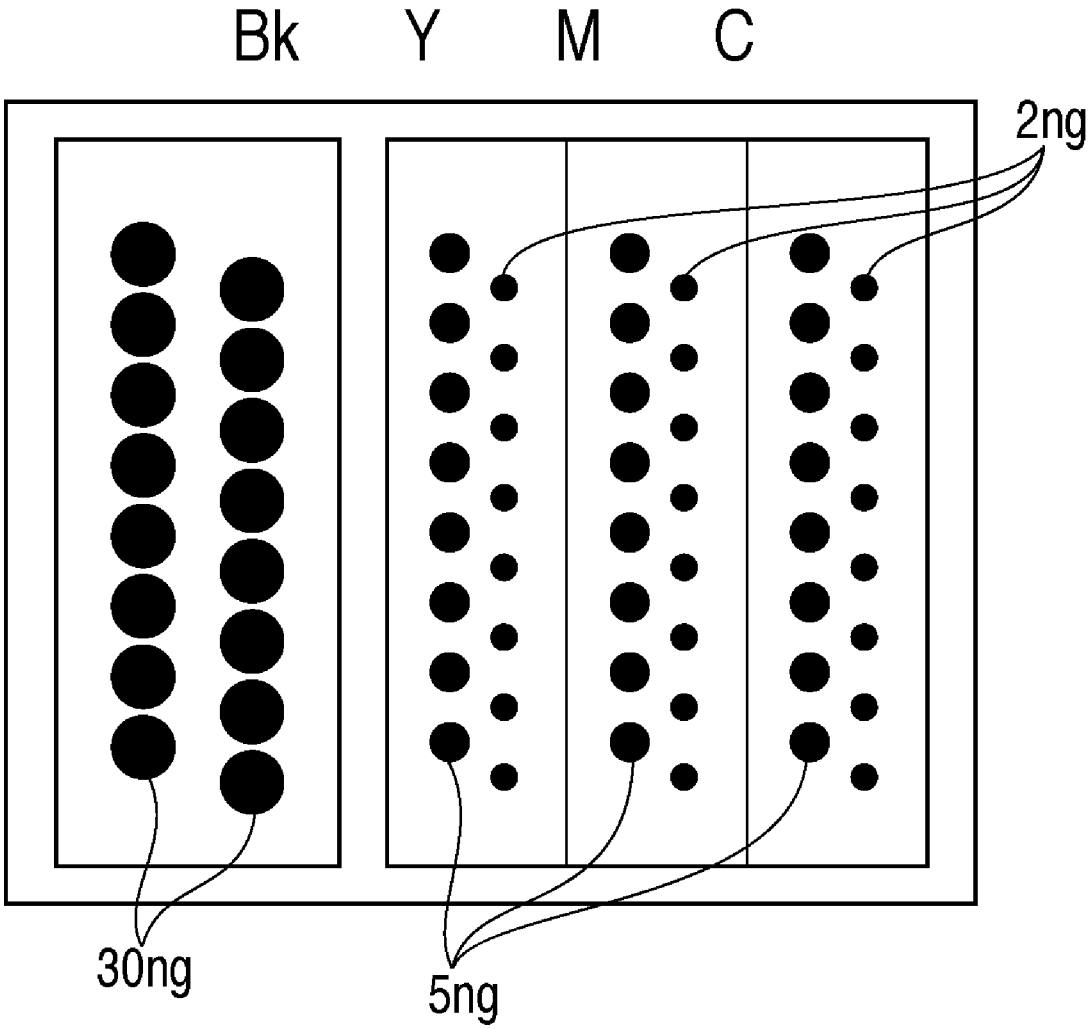
FIG. 6 is a schematic view showing the discharge orifice surface of a printhead.

The printhead 104 discharges inks of Bk, C, M, and Y. FIG. 6 is a schematic view showing the discharge orifice surface of the printhead 104. The printhead 104 is provided with 256 discharge orifices each of which can discharge ink of Bk with a weight of about 30 ng, three color-specific sets of 128 discharge orifices each of which can discharge ink of C, M, or Y with a weight of about 5 ng, and three color-specific sets of 128 discharge orifices each of which can discharge ink of C, M, or Y with a weight of about 2 ng. Although the printhead 104 in this embodiment is integrated with ink tanks which store inks, it may be separable from the ink tanks. The printhead 104 prints an image on the print medium 105 by discharging the inks supplied from the ink tanks from its orifices oriented downward in FIG. 6 onto the print medium 105.

Reference numeral 108 denotes a portion which mounts a switching unit and display unit. The switching unit is used to, for example, switch on/off the power supply of the printing apparatus and set various print modes. The display unit displays the state of the printing apparatus.

Figure 7:
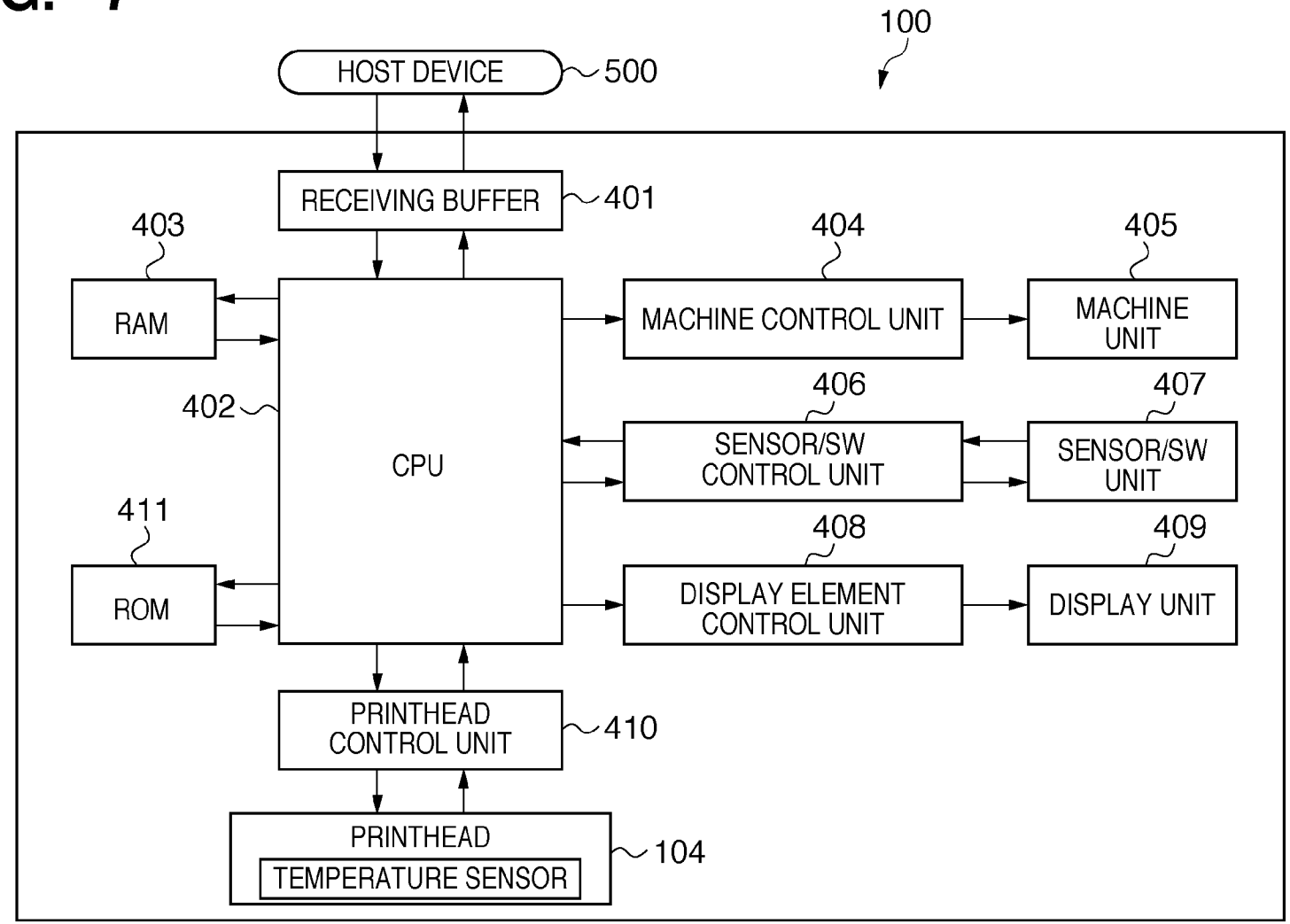
FIG. 7 is a block diagram showing an inkjet printing apparatus to which the present invention is applicable.

FIG. 7 is a block diagram showing an inkjet printing apparatus to which the present invention is applicable.

Data on an image to print is input from a host device 500, such as a personal computer, to a receiving buffer 401 of the printing apparatus 100. Data for confirming that the image data is input, and data for notifying the user of the operation state of the printing apparatus 100 are sent from the printing apparatus 100 to the host computer. The image data input to the receiving buffer 401 is transferred to a RAM 403 and temporarily stored in it under the control of a CPU 402. The CPU 402 controls the overall operation of the printing apparatus 100 based on, for example, a program stored in a ROM 411. A machine control unit 404 controls the driving of a machine unit 405 including, for example, a carriage motor and line feed motor in accordance with a command from the CPU 402.

A signal output from a sensor/SW unit 407 including various sensors and switches (SW) is sent to the CPU 402 under the control of a sensor/SW control unit 406.

The sensor/SW control unit 406 sends the signal from the sensor/SW unit 407 including various sensors and switches (SW) to the CPU 402. A display element control unit 408 controls a display unit 409 including, for example, an LED or liquid crystal display element of a display panel in accordance with a command from the CPU 402.

A printhead control unit 410 controls the printhead 104 in accordance with a command from the CPU 402. In addition, the printhead control unit 410 detects pieces of information representing the state of the printhead, such as the temperature of the printhead 104 detected by a temperature sensor provided to it, and sends these pieces of information to the CPU 402 to appropriately process them.

Single Pulse

Figure 8:
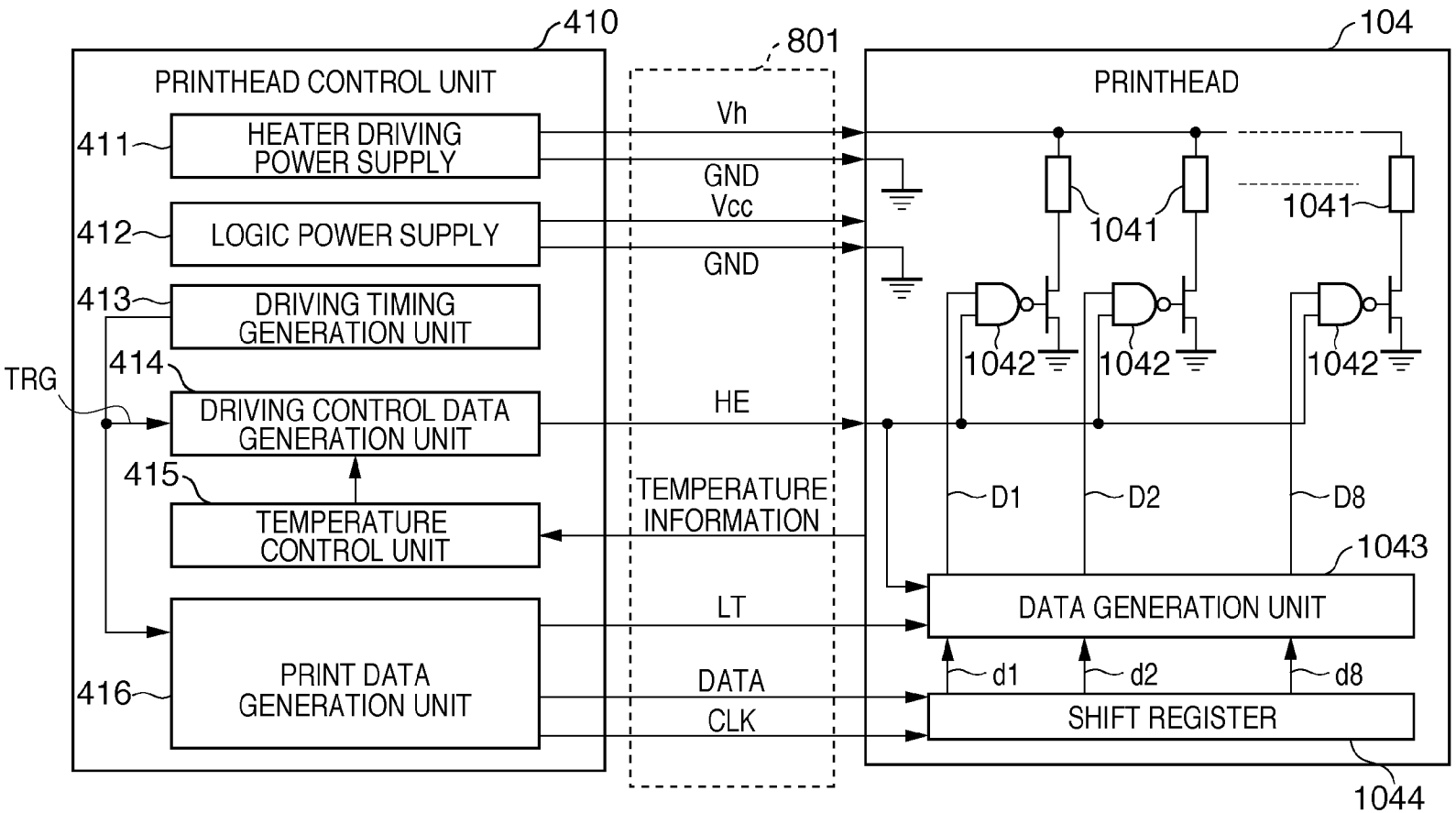
FIG. 8 is a schematic view showing the configuration of a printhead control unit and printhead which can practice the present invention.

FIG. 8 is a schematic view showing the configuration of the printhead control unit 410 and the printhead 104 according to this embodiment.

The printhead control unit 410 includes a heater driving power supply 411 for generating a voltage Vh (20 V) to drive heaters, a logic power supply 412 for generating a logic voltage Vcc (5 V), a driving timing generation unit 413, a driving control data generation unit 414, a temperature control unit 415, and a print data generation unit 416. The print data generation unit 416 generates print data DATA of 8 bits (d1, d2, . . . , d8). This 8-bit data is column data. The driving timing generation unit 413 outputs a driving trigger signal TRG to the driving control data generation unit 414 and print data generation unit 416. The print data generation unit 416 transfers a signal LT or HE or the print data DATA to the printhead 104 in synchronism with the driving trigger signal TRG. These signals are transferred based on a clock signal CLK.

The printhead 104 will be explained next. For the sake of descriptive simplicity, the printhead 104 is assumed to have eight discharge orifices for each ink color. The printhead 104 includes one heater 1041 and driving circuit 1042 in correspondence with one discharge orifice. The driving circuit 1042 includes a logic circuit and switching circuit (switching element). An example of the logic circuit is a NAND circuit which calculates the NAND of a heat enable signal HE and a signal output from a data generation unit 1043. The switching circuit is a transistor which drives the heater based on the calculation result output from the logic circuit.

The printhead 104 also includes a shift register 1044 for inputting the print data DATA output from the print data generation unit 416 in synchronism with the clock signal CLK. The printhead also includes the data generation unit 1043 for inputting the data held in the shift register 1044 and outputting a 1-bit signal to each driving circuit 1042. The data generation unit 1043 includes a latch for latching the data held in the shift register 1044, in response to a latch signal LT output from the print data generation unit 416. The latch inputs the heat enable signal HE output from the driving control data generation unit 414, and outputs a signal to the driving circuit 1042. The shift register 1044 inputs the next 8-bit print data from the print data generation unit 416. After inputting the next print data, the data generation unit 1043 inputs the data held in the shift register 1044 in response to a subsequently input latch signal.

The temperature information of the printhead is output to the temperature control unit 415 of the printhead control unit 410 based on information on a diode (not shown) integrated with the printhead.

The printhead control unit 410 and the printhead 104 are connected via a flat cable 801, as indicated by the broken line. The flat cable 801 includes, for example, lines for the signals DATA, LT, HE, and CLK, power supply lines for the voltages Vh and Vcc, and a ground line GND. The voltages Vh and Vcc provided by the power supply lines are supplied to the heater 1041 and driving circuit 1042.

Figure 9:
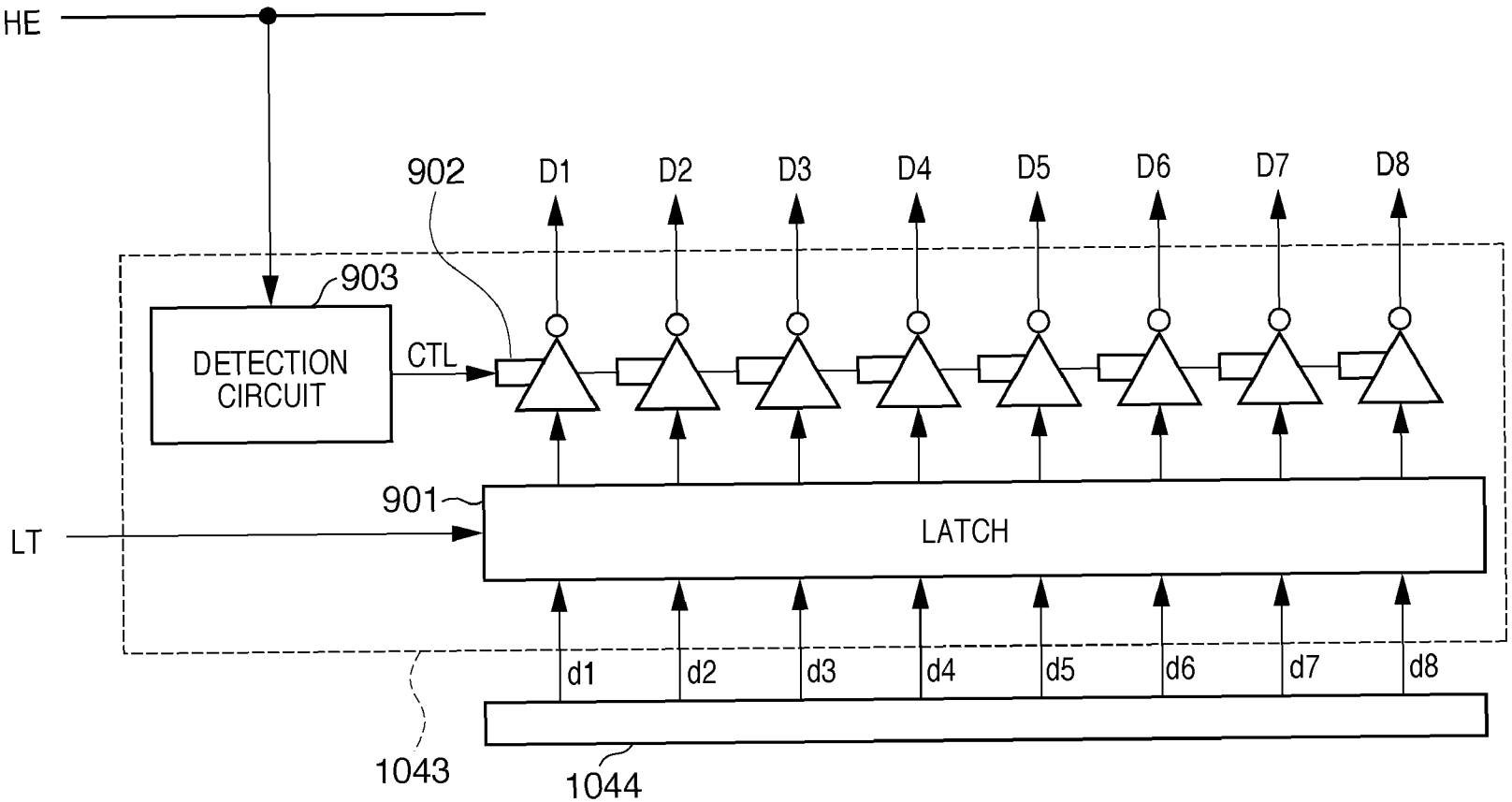
FIG. 9 is a schematic view showing a latch which can practice the present invention.

FIG. 9 is a schematic view showing the data generation unit 1043 according to this embodiment. The data generation unit 1043 includes a latch 901 for latching (holding) the data d1 to d8, which are input from the shift register 1044, in response to the latch signal LT. The 8-bit data including the data d1 to d8 held by the latch 901 is transferred to an inversion unit (inverter) 902.

A detection circuit (edge detection circuit) 903 inputs the signal HE and generates a signal CTL to control the inversion unit 902. The detection circuit 903 outputs a signal CTL every time it detects the leading and trailing edges of the signal HE.

The inversion unit 902 inputs the signal CTL output from the driving control data generation unit 414, and directly outputs the value of the data dn as a signal Dn or outputs a value obtained by inverting the value of the data dn as a signal Dn. The inversion unit 902 is set to be ready to directly output the value of the data dn as a signal Dn every time it inputs a latch signal. This processing will be explained with reference to FIGS. 1A and 1B.

Figure 1A:
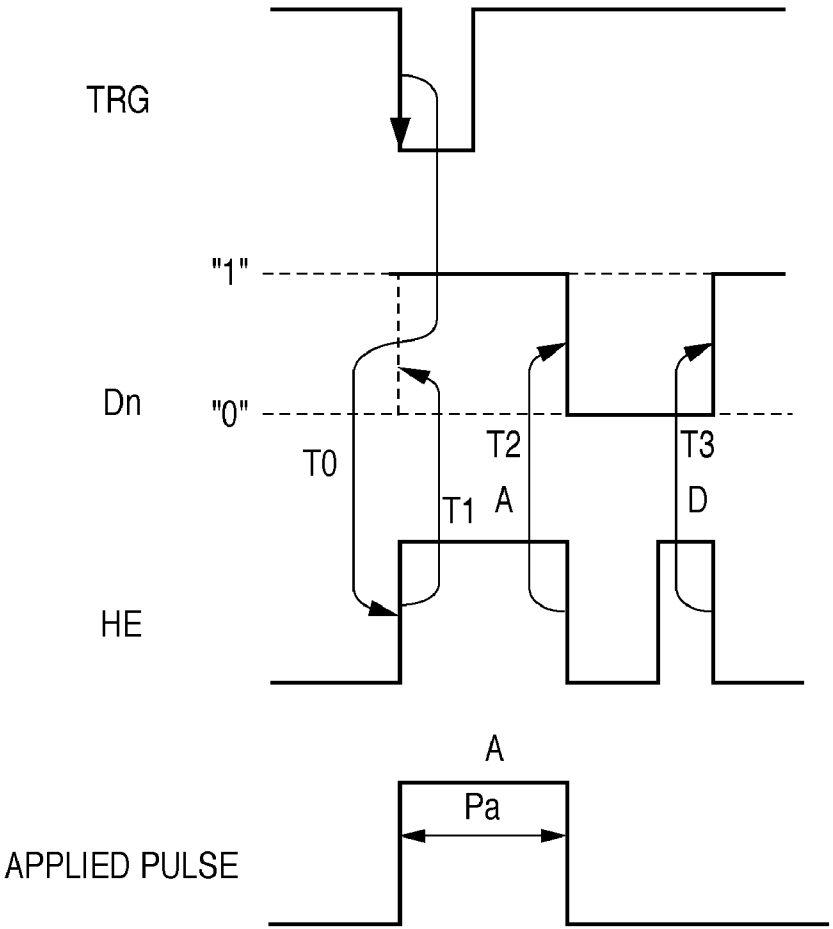
FIGS. 1A and 1B are timing charts for explaining the driving of a printhead according to the first embodiment, which discharges ink by applying a single pulse driving voltage to a heater.
Figure 1B:
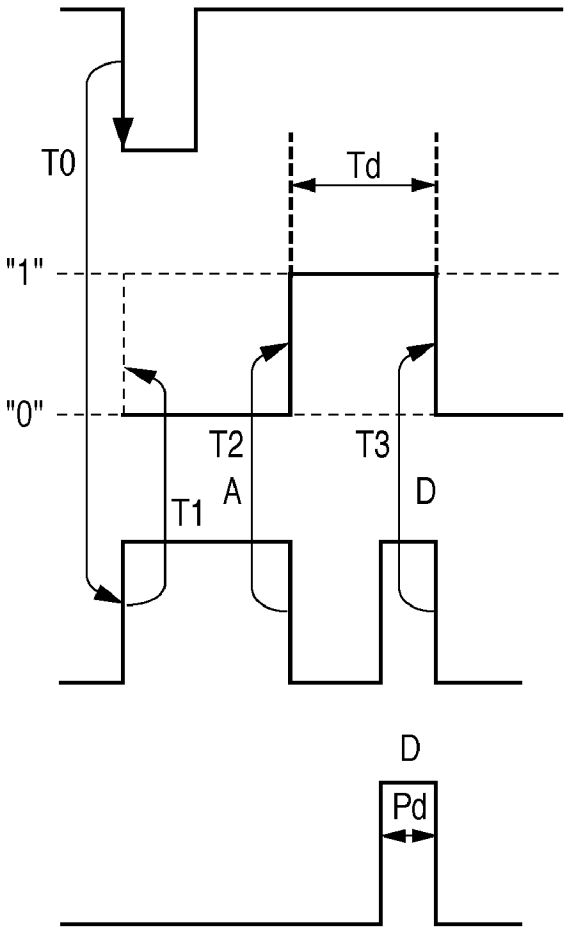
Figure 2A:
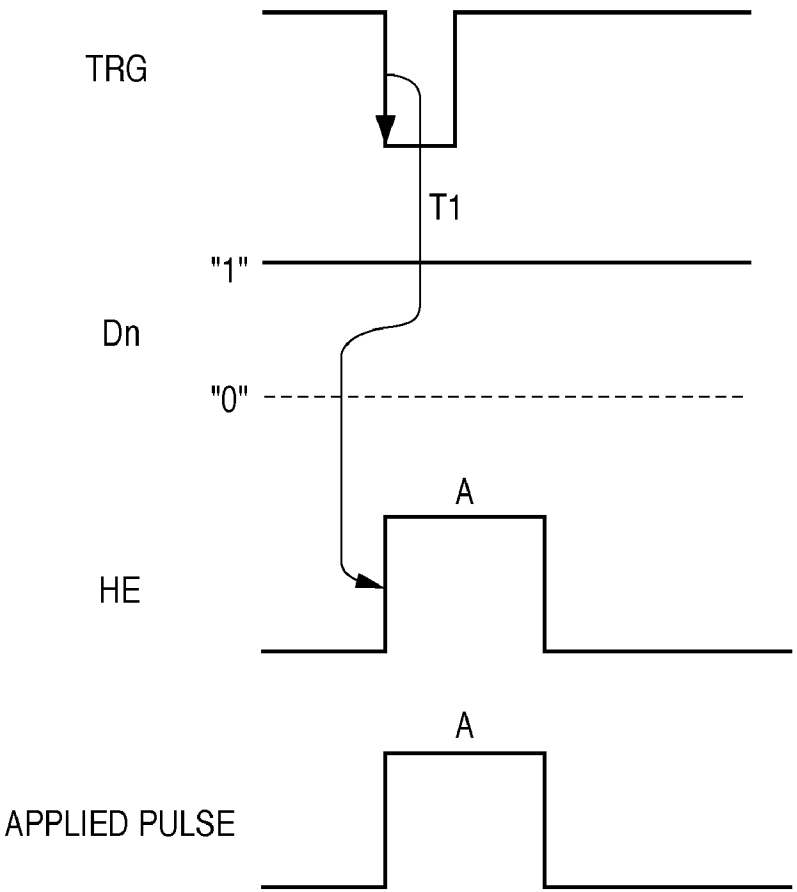
FIG. 2A PRIOR ART
FIGS. 2A and 2B are timing charts for explaining the driving of a conventional printhead which discharges ink by applying a single pulse driving voltage to a heater.
Figure 2B:
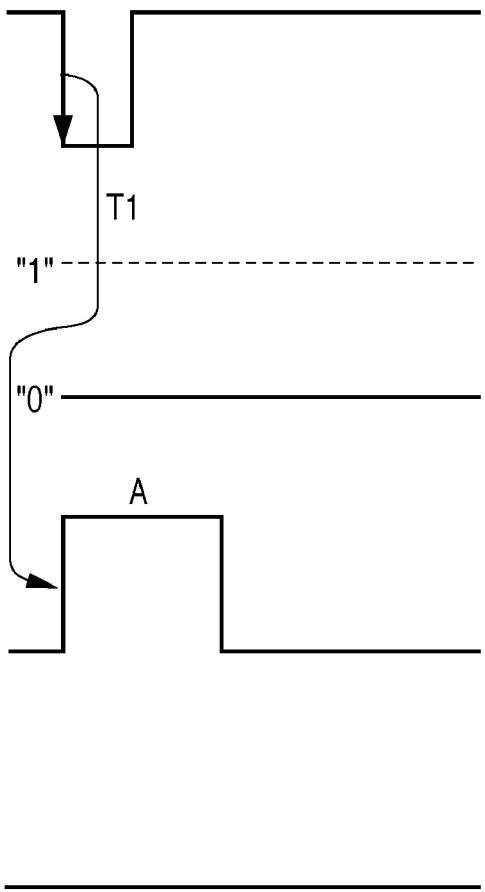
FIG. 2B PRIOR ART

FIGS. 2A and 2B are timing charts for explaining the driving of a conventional printhead which discharges ink by applying a single pulse driving voltage to a heater, for comparison with this embodiment. FIGS. 2A and 2B are explanatory timing charts of one ink discharge by the driving of one heater. One dot is printed on a print medium by one ink discharge. The same applies to FIGS. 1A and 1B to be described later. FIG. 2A is a timing chart of signals TRG, Dn (n is 1 to 8), and HE, and a driving waveform generated based on them when ink is discharged. FIG. 2B is a timing chart of signals TRG, Dn (n is 1 to 8), and HE, and a driving waveform generated based on them when ink is not discharged. In practice, a plurality of dots is printed by periodically inputting the above-described signals to the printhead.

The signal HE having a pulse A is common to nozzles which discharge inks of the same color by the same amount. The data Dn (n is 1 to 8) controls whether to drive the respective nozzles (apply voltages to the respective heaters). In other words, the data Dn (n is 1 to 8) is information representing whether to discharge inks. The signal HE is sent from the printhead control unit 410 to the printhead 104 in synchronism with the driving trigger signal. The NAND of the signal HE and the data Dn is calculated, thereby driving the heater of the selected nozzle. Referring to FIG. 2A, since the data Dn is "1" (High Level), a voltage of a driving waveform having a pulse A is applied to the heater, thereby discharging ink. Referring to FIG. 2B, since the data Dn is "0" (Low Level), no voltage is applied to the heater and, in turn, ink is not discharged. In this manner, the prior art has directly used the data Dn sent from the shift register for heater driving control.

Printhead driving according to this embodiment will be explained next. FIGS. 1A and 1B are timing charts for explaining the driving of a printhead according to this embodiment, which discharges ink by applying a single pulse driving voltage to a heater. FIG. 1A is a timing chart of signals TRG, Dn (n is 1 to 8), and HE, and a driving waveform generated based on them when ink is discharged, as in FIG. 2A. FIG. 1B is a timing chart of signals TRG, Dn (n is 1 to 8), and HE, and a driving waveform generated based on them when ink is not discharged, as in FIG. 2B.

First, FIG. 1A is an explanatory timing chart when the value of the data dn transferred from the shift register is "1". At timing T1 at which the signal HE rises, "1" is output as the value of the signal Dn. Until a timing at which the signal HE falls, "1" is held as the value of the signal Dn. Note that n is one of 1 to 8. With this operation, a driving waveform (driving pulse) having a pulse A with a pulse width Pa is applied to the heater, as in FIG. 2A, while the pulse A of the signal HE is input to the driving circuit. Ink is thus discharged in response to the pulse A. As the signal HE falls at timing T2, the output value of the data Dn changes from "1" to "0". Until timing T3, "0" is held. For this reason, even when a pulse D of the signal HE is input to the driving circuit of the heater, a driving pulse corresponding to the pulse D is not applied to the heater.

FIG. 1B is an explanatory timing chart when the value of the data dn transferred from the shift register is "0". At timing T1 at which the signal HE rises, "0" is output as the value of the signal Dn. Until timing T2 at which the signal HE falls, "0" is held as the value of the signal Dn. As the signal HE falls at timing T2, the value of the signal Dn changes from "0" to "1". At timing T3 a time period Td after timing T2, a pulse D of the signal HE falls, and the value of the signal Dn changes from "1" to "0". In this manner, because the value of the signal Dn is "1" during the time period Td, and the pulse D of the signal HE is input to the driving circuit of the heater in this state, a waveform (driving pulse) having a pulse D with a pulse width Pd is applied to the heater. This makes it possible to maintain the heater at a high temperature. Note that the signal HE rises in synchronism with output timing T0 of the signal TRG.

The pulse width of the pulse A corresponds to a time for which a desired amount of ink is discharged and, for example, is 20-V 1.5 μs. The pulse D corresponds to a time for which the printhead can maintained at a high temperature and which is short enough not to discharge ink. For example, if a heater having a resistance of 800Ω is applied with a pulse having a width corresponding to 20-V 1 μs with a driving frequency of 20 kHz, it can be heated with $20\times(20/800)\times(20\times10^{3}\times10^{-6})=$ 10 W per sec. The driving control data generation unit 414 controls the pulse width of the signal HE on the basis of the temperature information of the printhead.

With such a simple configuration, a nozzle which does not discharge ink can be heated and maintained at a high temperature while driving a nozzle which discharges ink in the same way as in the prior art. Still better, the number of wiring lines from the printhead control unit to the printhead never increases as compared with a general conventional printing apparatus.

Double Pulse

The above-described (first) embodiment has exemplified a driving method for a printhead which discharges ink by applying a single pulse driving voltage to a heater. A second embodiment will exemplify a driving method for a printhead which discharges ink by applying a double pulse driving voltage to a heater. In driving the printhead by the double pulse, first, a pulse having energy in an amount small enough not to discharge ink (preheat pulse) is applied to the heater to increase the temperature of ink around it. After that, a pulse having energy in an amount large enough to discharge ink is applied to the heater to discharge ink. When the same amount of energy is applied to the heater, a double pulse can discharge ink in a larger amount than a single pulse. The circuitry of the inkjet printing apparatus according to this embodiment is the same as in the first embodiment.

Figure 4A:
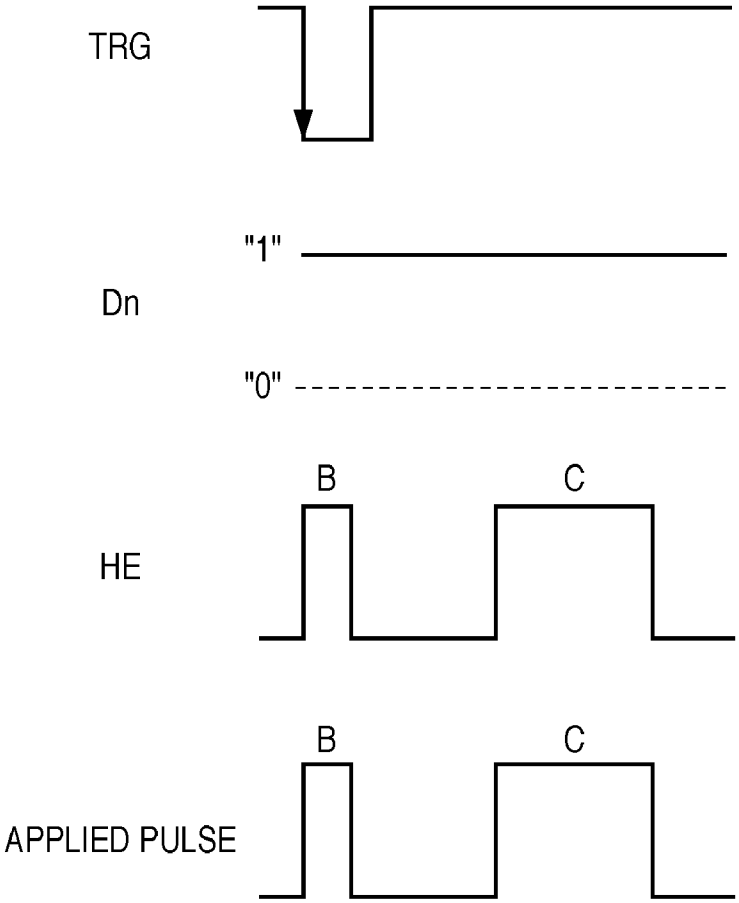
FIG. 4A PRIOR ART
FIGS. 4A and 4B are timing charts for explaining the driving of a conventional printhead which discharges ink by applying a double pulse driving voltage to a heater.
Figure 4B:
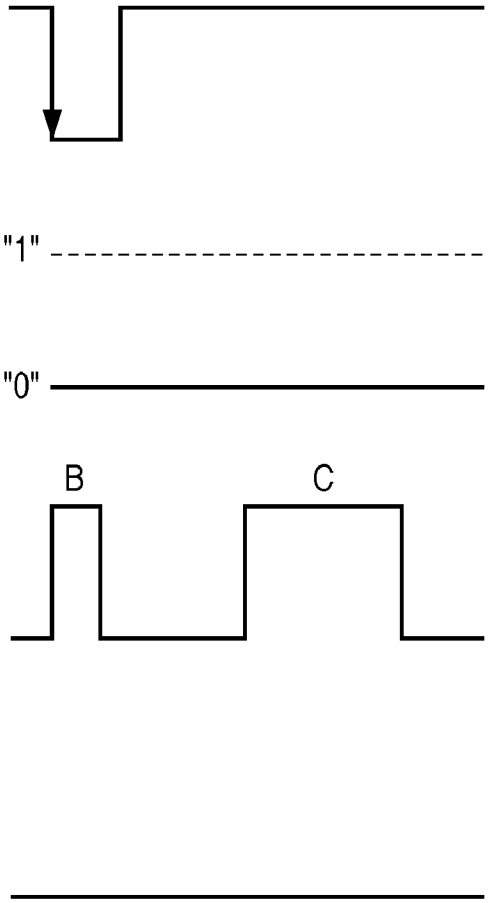
FIG. 4B PRIOR ART

FIGS. 4A and 4B are timing charts for explaining the driving of a conventional printhead which discharges ink by applying a double pulse driving voltage to a heater, for comparison with this embodiment. FIG. 4A is a timing chart of a driving trigger signal TRG and signals Dn and HE, and a driving waveform generated based on them when ink is discharged, as in FIG. 2A. FIG. 4B is a timing chart of a driving trigger signal TRG and signals Dn and HE, and a driving waveform generated based on them when ink is not discharged, as in FIG. 2B. A pulse B is the one to increase the temperature of ink around the heater with energy in an amount small enough not to discharge ink. A pulse C is the one having energy in an amount large enough to discharge ink.

Figure 3A:
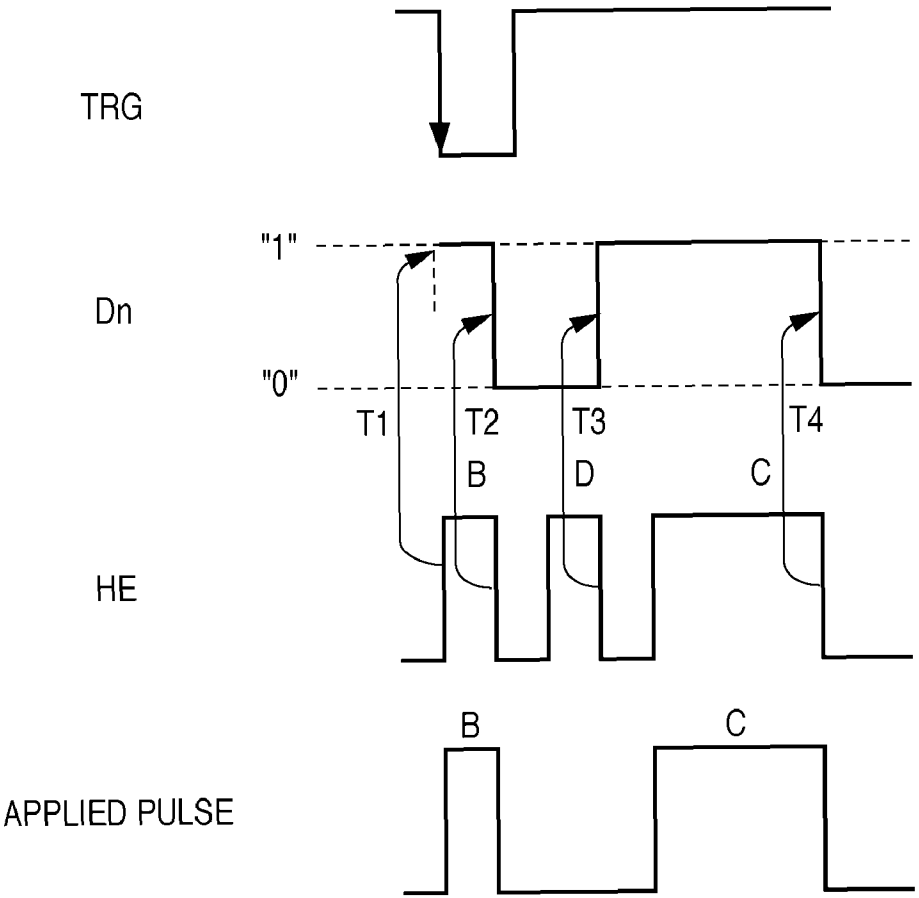
FIGS. 3A and 3B are timing charts for explaining the driving of a printhead according to the second embodiment, which discharges ink by applying a double pulse driving voltage to a heater.
Figure 3B:
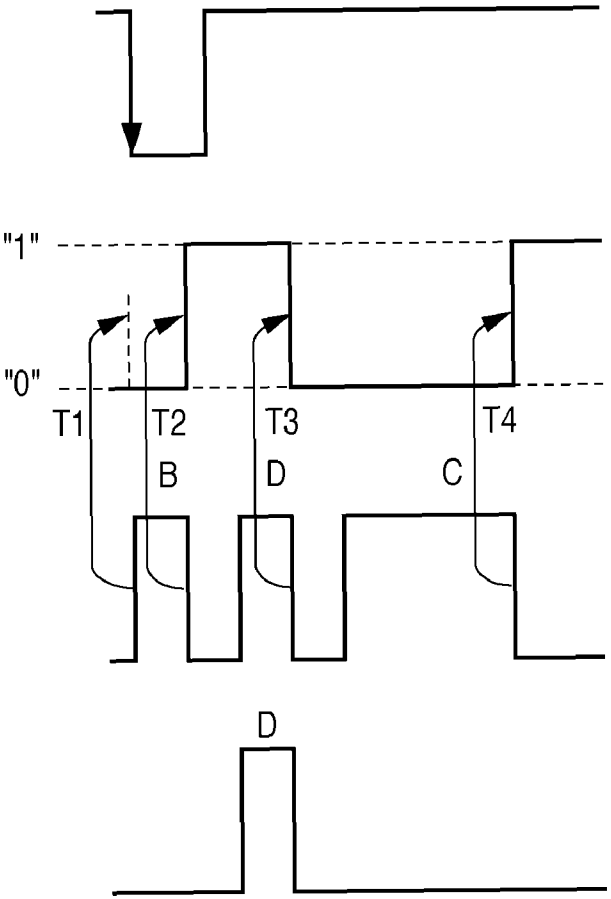

Printhead driving according to this embodiment will be explained next. FIGS. 3A and 3B are timing charts for explaining the driving of a printhead according to this embodiment, which discharges ink by applying a double pulse driving voltage to a heater. FIG. 3A is an explanatory timing chart of a driving trigger signal TRG and signals Dn and HE, and a driving waveform generated based on them when ink is discharged, as in FIG. 2A. FIG. 3B is a timing chart of a driving trigger signal TRG and signals Dn and HE, and a driving waveform generated based on them when ink is not discharged, as in FIG. 2B.

Since the control in FIG. 3A is the same as in FIG. 1A, a description thereof will be given simply. FIG. 3A is an explanatory timing chart when the value of data dn transferred from a shift register is "1". At timing T1 at which the signal HE rises, "1" is output as the value of the signal Dn. The value of the signal Dn is changed every time a timing T2, T3, or T4 at which the signal HE falls comes, as shown in FIG. 3A. By inputting a pulse B of the signal HE to the driving circuit of the heater when the value of the signal Dn is "1", a voltage pulse corresponding to the pulse B is applied to the heater, as in FIG. 4A. During the output of a pulse C of the signal HE, a voltage pulse corresponding to the pulse D is not applied to the heater because the value of the signal Dn is "0". Also, during the output of a pulse C of the signal HE, a voltage pulse corresponding to the pulse C is applied to the heater because the value of the signal Dn is "1". In this manner, the driving waveform shown in FIG. 3A becomes the same as that shown in FIG. 4A.

FIG. 3B is an explanatory timing chart when the value of the data dn transferred from the shift register is "0". At timing T1 at which the signal HE rises, "0" is output as the value of the signal Dn. The value of the signal Dn is changed every time a timing T2, T3, or T4 at which the signal HE falls comes, as shown in FIG. 3B. By inputting a pulse D of the signal HE to the driving circuit of the heater when the value of the signal Dn is "1", a voltage pulse corresponding to the pulse D is applied to the heater. During the output of pulses B and C of the signal HE, a voltage pulse is not applied to the heater because the value of the signal Dn is "0". This makes it possible to heat the heater of a corresponding nozzle.

The above-described (first) embodiment has exemplified a printhead driving method when a single pulse driving voltage is applied to a heater. The above-described (second) embodiment has exemplified a printhead driving method when a double pulse driving voltage is applied to a heater. These embodiments are practiced using the configurations shown in FIGS. 8 and 9. A third embodiment will exemplify another circuitry with reference to FIG. 11.

Figure 11:
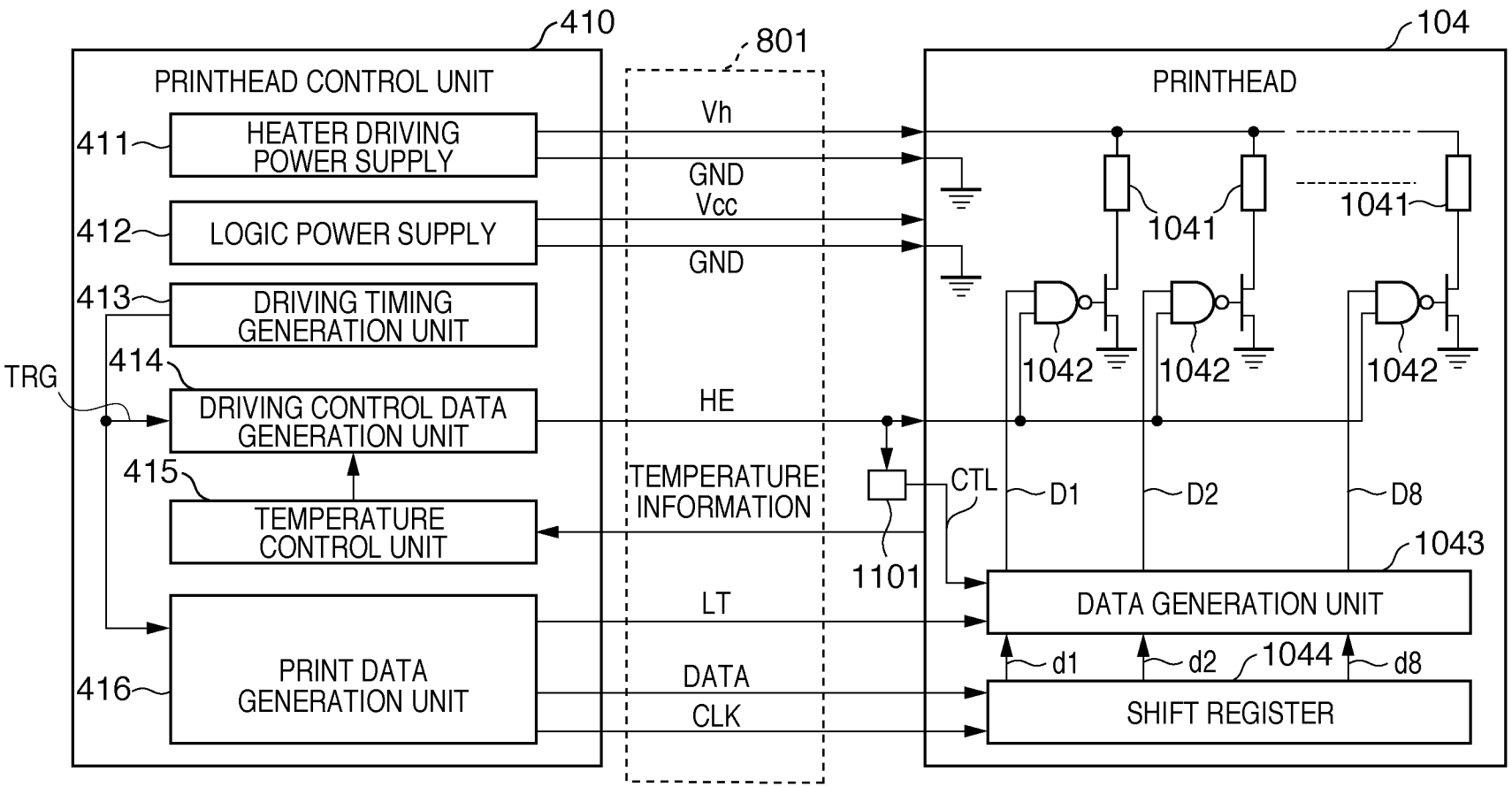
FIG. 11 is a schematic view showing a configuration in which a control signal generation unit is set outside a printhead according to the third embodiment.

In FIG. 11, circuit components different from those in FIG. 8 will be explained, and a description of the same circuit components as in FIG. 8 will not be given.

The difference between FIGS. 11 and 8 lies in that a detection circuit 1101, which detects a signal HE and generates a control signal CTL, is set outside a printhead 104. In the third embodiment, the detection circuit 1101 is built in a holding member which holds the printhead. For example, the detection circuit 1101 may be built in a carriage 101, as shown in FIG. 5.

The above-described (first and second) embodiments have exemplified cases in which the driving waveforms have a single pulse and double pulse, respectively. A plurality of pulse widths can be set for these driving waveforms for each ink discharge. For example, in the first embodiment, the pulses A and D may be set to have desired widths on the basis of, for example, the temperature of the printhead detected by the temperature sensor. Also, in the second embodiment, the pulses B, C, and D may be set to have desired widths. Note that if the logic of the signal HE is inverse, the value of the signal Dn need only be inverted in a rise (leading edge) of the signal HE.

Figure 10:
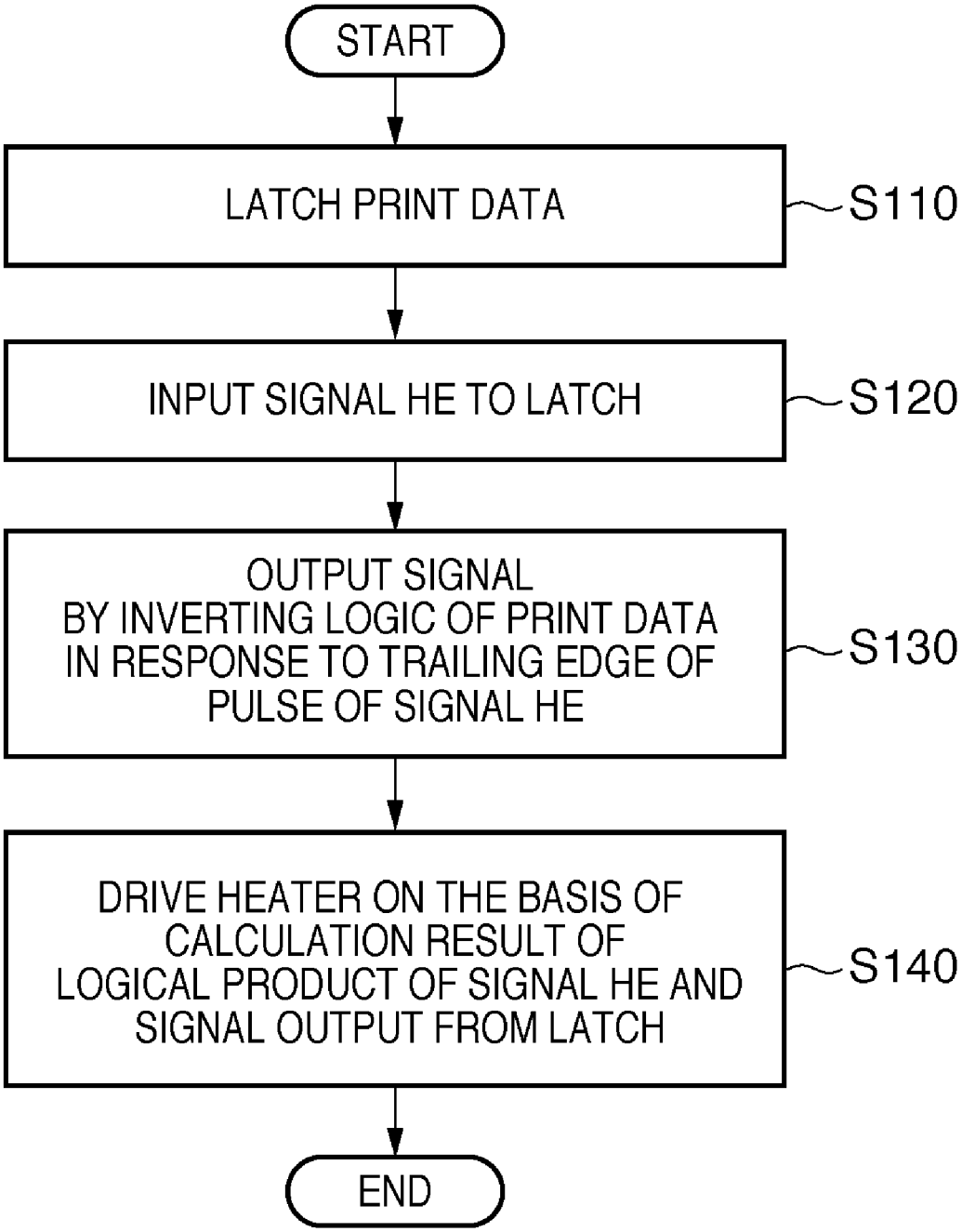
FIG. 10 is a flowchart for explaining a printhead driving method according to one embodiment of the present invention.

A printhead driving method based on the printhead driving according to each of the above-described embodiments will be explained below with reference to the flowchart in FIG. 10.

First, in step S110, print data is input and latched by the latch of the printhead. Next, in step S120, a signal HE having a pulse, which has a relatively wide width to discharge ink and that which has a relatively narrow width to heat ink around the heater, is input to the latch. In step S130, a signal is output from the latch by inverting the logic of the print data, which is latched every time the signal HE is input, in response to the trailing edge of the pulse of the signal HE. In step S140, the driving circuit calculates the logical product of the signal HE and the signal output from the latch, thereby driving the heater on the basis of the calculation result.

Printhead driving as shown in FIGS. 4A and 4B makes it possible to heat the printhead in response to the pulse B before the pulse C to discharge ink is applied to the heater. However, ink discharge and printhead heating cannot be controlled independently, which often makes it impossible to perform precise temperature control and precise ink discharge control.

In contrast, the present invention can independently control ink discharge and printhead heating, which allows precise temperature control and precise ink discharge control.

According to the present invention, it is possible to maintain a printhead at a constant temperature by applying energy to a heater which does not discharge ink in printing, independently of print control, with a simple configuration and low cost.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-312657 filed on Dec. 3, 2007, which is hereby incorporated by reference herein in its entirety.

What is claimed is:

1. A printhead including a driving unit configured to drive a plurality of heaters, and a register configured to receive data of a plurality of bits corresponding to the number of heaters, the printhead comprising:

a latch configured to hold the data transferred from the register; and a generation unit configured to receive an enable signal comprising a first pulse waveform and a second pulse waveform, different from the first pulse waveform and formed after the first pulse waveform, generate a control signal for driving the heaters based on the enable signal and output the control signal to the driving unit, wherein the generation unit generates the control signal corresponding to the first pulse waveform in the case where a value of the data held by the latch is a predetermined value, and generates the control signal corresponding the second pulse waveform in the case where a value of the data held by the latch is different from the predetermined value.

2. The printhead according to claim 1, wherein the driving unit comprises:

a logic circuit configured to receive the control signal and the enable signal; and a switching element configured to drive the heater based on a result output from the logic circuit.

3. A printing apparatus which prints using a printhead according to claim 1, the printing apparatus comprising:

a print data generation unit configured to generate the enable signal and the data of a plurality of bits; and a transfer unit transferring the enable signal and the data of a plurality of bits generated by the print data generation unit to the printhead.

4. The printhead according to claim 1, wherein the generation unit comprises an inversion unit configured to receive the data held by the latch, and hold the value of the received data until a predetermined edge in the first pulse waveform and the second pulse waveform occurs, and change the value of the received data every time the predetermined edge occurs.

5. The printhead according to claim 1, wherein the generation unit comprises a detection unit configured to detect a predetermined edge in the first pulse waveform-and the second pulse waveform.

6. A driving method for a printhead including a driving unit configured to drive a plurality of heaters, and a register configured to receive data of a plurality of bits corresponding to the number of heaters, the method comprising:

holding the data transferred from the register; and receiving an enable signal comprising a first pulse waveform and a second pulse waveform, different from the first pulse waveform and formed after the first pulse waveform;

generating a control signal for driving the heaters based on the enable signal; and outputting the control signal to the driving unit, wherein the control signal is generated to correspond to the first pulse waveform in the case where a value of the data held by the latch is a predetermined value, and the control signal is generated to correspond to the second pulse waveform in the case where a value of the data held by the latch is different from the predetermined value.

* * * * *